United States Patent [19]

Gross et al.

[11] Patent Number: 4,459,963

[45] Date of Patent: Jul. 17, 1984

[54] ELECTRICALLY CONTROLLED FUEL INJECTION APPARATUS FOR MULTI-CYLINDER INTERNAL COMBUSTION ENGINES

[75] Inventors: Werner Gross, Ismaning; Max Straubel, Stuttgart, both of Fed. Rep. of Germany

[73] Assignee: Robert Bosch GmbH, Stuttgart, Fed. Rep. of Germany

[21] Appl. No.: 362,375

[22] Filed: Mar. 26, 1982

[30] Foreign Application Priority Data

Mar. 28, 1981 [DE] Fed. Rep. of Germany ..... 3112381

[51] Int. Cl.[3] ..... F02M 39/00; F02D 1/04

[52] U.S. Cl. ..... 123/506; 123/338; 123/458; 123/459; 123/357; 123/500; 123/501; 123/502

[58] Field of Search ..... 123/458, 459, 446, 506, 123/500, 501, 502, 338, 357, 472

[56] References Cited

U.S. PATENT DOCUMENTS

| | | | |
|---|---|---|---|
| 1,664,610 | 4/1928 | French | 123/32 AE |
| 1,668,919 | 5/1928 | Lundstrom | 123/506 |
| 3,742,918 | 7/1973 | Murtin | 123/506 |
| 3,779,225 | 12/1973 | Watson et al. | 123/139 E |
| 3,896,779 | 7/1975 | Omori et al. | 123/139 |
| 4,129,253 | 12/1978 | Bader, Jr. et al. | 239/88 |
| 4,271,805 | 6/1981 | Kobayashi | 123/506 |
| 4,343,280 | 8/1982 | Luscomb | 123/506 |

FOREIGN PATENT DOCUMENTS

| | | | |
|---|---|---|---|
| 1176110 | 11/1958 | France | 123/506 |

*Primary Examiner*—Ronald B. Cox
*Attorney, Agent, or Firm*—Edwin E. Greigg

[57] ABSTRACT

A fuel injection apparatus in which the duration of fuel supply of at least two pump pistons of a fuel injection pump is determined by the closing duration of an electrically actuated overflow valve. The overflow conduits of at least two adjacent pump work chambers are interconnected, and the return flow of fuel from these overflow conduits to a chamber of lower pressure is controllable by the control element of the overflow valve which is common to these overflow conduits. The overflow conduits are each provided with one barrier valve, by means of which the at least one pump work chamber not under injection pressure at a given time can be blocked off from the pump work chamber which is placed under injection pressure at that time.

26 Claims, 8 Drawing Figures

ELECTRICALLY CONTROLLED FUEL INJECTION APPARATUS FOR MULTI-CYLINDER INTERNAL COMBUSTION ENGINES

BACKGROUND OF THE INVENTION

The invention relates generally to fuel injection apparatus and more particularly to an electrically controlled fuel injection apparatus for direct fuel injection in multi-cylinder internal combustion engines.

In a known fuel injection apparatus of this type described in U.S. Pat. No. 3,779,225, a magnetic valve, embodied as a slide valve, is associated with a pump piston of a fuel injection pump. By the duration of its actuation for closing the overflow conduit, this magnetic valve determines both the onset and end of fuel supply. In this fuel injection pump, intended in particular for high-pressure fuel injection, each pump work chamber must be controlled by a magnetic valve, so that in the case of multi-cylinder internal combustion engines, the engineering expense is very great. Also, it becomes difficult to set the individual magnetic valves to an identical actuation speed and duration, as must be done so that with identical actuation pulses, the individual pumping elements will deliver the identical fuel quantity to the injection nozzle.

In a fuel injection apparatus of similar design, as described in French Pat. No. 1,176,110, FIG. 8, this last disadvantage does not exist, because only one magnetic valve is used; but only one pump piston is used as well. There is the disadvantage not only that this magnetic valve controls only the end of fuel supply, but also that the individual injection nozzles must then be individually triggered by an additional electromagnet, since the sole pump piston feeds fuel into a distributor line to which the individual injection nozzles are connected; thus the advantage of having only one overflow valve is undone by the multiplicity of electrically triggered injection nozzles. Furthermore, because of the interconnecting injection lines, the particular clearance volume which is effective during injection is disadvantageously enlarged.

The same disadvantages are found in a fuel injection apparatus known from U.S. Pat. No. 1,664,610, in which a single electromagnetically triggered intake valve controls a variable injection onset and thus the supply quantity; the fuel fed by a single pump piston is distributed to the individual injection nozzles via electromagnetically controlled distributor valves connected to a distributor chamber. Here, again, the engineering expense is very high, and in contrast to individual injection pumps the pump piston here must execute a number of pump strokes per camshaft revolution which corresponds to the number of cylinders of the engine; especially when the apparatus is to be used in high-speed vehicle engines, this necessarily causes difficulties, particularly in filling the pump work chamber.

OBJECT AND SUMMARY OF THE INVENTION

It is the object of the invention, utilizing known control elements to a great extent and simultaneously simplifying them while undergoing low structural expense, to obtain a compact injection apparatus which assures precise fuel quantity metering over an rpm range that is relatively wide for vehicle motores and further assures a correction of injection onset that can be shifted over a very wide angular range. In particular, the object is to be able to use such an injection apparatus for direct fuel injection in internal combustion engines having externally-supplied ignition and operating with a stratified charge. Such engines operate at injection pressures of 20 bar, for example, which are substantially lower than those conventional for Diesel engines, with peak pressures of approximately 60 bar; however, they require an extremely large angular range, for instance 60° of camshaft angle, to effect the correction of injection onset in accordance with both rpm and load, so that the overall result is a wide supply range, such as 110° of camshaft angle.

In the fuel injection apparatus according to the invention, each pump piston of a fuel injection pump, which is driven at a constant stroke by a drive cam of a camshaft and is guided in a cylinder bore of the pump, supplies the fuel placed under injection pressure in an associated pump work chamber via a pressure valve to an injection nozzle until such time as a valve element of an electrically actuated overflow valve blocks the flow of the fuel overflowing from the pump work chamber via an overflow conduit to a chamber of lower pressure. The overflow conduits of at least two adjacent pump work chambers are interconnected and the return flow of fuel out of these overflow conduits to the chamber of lower pressure is controllable by the valve elements of the overflow valve common to these overflow conduits. The overflow conduits are each provided with a barrier valve, by means of which the at least one pump work chamber which is not under injection pressure can be blocked off from the pump work chamber which is under injection pressure at that time. Both the onset and duration of injection of at least two pump pistons are controlled by a single overflow valve, with the pump work chamber or chambers not subject to injection pressure at a particular time being blocked off by the barrier valve. The disclosed combination of characteristics retains the advantage of the pump piston associated with the individual injection nozzles, while simultaneously simplifying the electric triggering of the required overflow valves, whose number relative to the pump pistons is reduced by at least half; thus any random variations from one valve to another will have less effect.

The barrier valves, when embodied as check valves, function fully automatically and require no supplementary control means. In a fuel injection pump for the fuel injection apparatus according to the invention, having one filling conduit discharging into each pump work chamber and exposed via a filling line to the supply pressure of a pre-supply pump such as is known from the prior art discussed above, it is possible to embody the pump piston as a simple cylindrical plunger by using filling valves embodied as check valves disposed in respective filling conduits; this simplifies the manufacture of the pump piston and enables its use even at very high injection pressures, because no lateral forces are exerted on the pump piston such as would be the case if there were any control bores or control edges. Each filling conduit may discharge into a portion of the overflow conduit disposed between the barrier valve and the pump work chamber. This produces a very simple conduit course, so that a portion of the overflow conduit simultaneously servers as a portion of the filling conduit.

In further embodiments of the invention, the fuel injection pump has an inlet opening of a filling conduit which is under the supply pressure of a supply pump, the inlet opening being closable by a first control face on the jacket face of the pump piston after a pre-stroke of the pump piston has been completed. An overflow opening in the wall of each cylinder bore serves as the discharge point of the overflow conduit. A second control face on the pump piston acts as the barrier valve closing the overflow opening in one of the dead center positions of the pump piston. Alternatively, the first control face may also serve as the barrier valve. The characteristics of these further embodiments advantageously result in a substantial simplification of the control of the pump work chambers, which are each controlled by one overflow valve, because the pump piston control face, acting as a barrier valve, precludes the problems associated with providing installation space and sealing which an additional valve would present. Because the pump piston acts as a barrier in one of its dead-center positions, no additional control means of any kind are required to block whichever pump work chambers are not actuated at a particular time.

Also, the pump work chamber can be filled with fuel under supply pressure from a filling line via a second filling conduit which is provided with a check valve opening toward the pump work chamber and is not capable of being influenced by the pump piston. By means of this second filling conduit very satisfactory filling of the pump work chamber is assured during the intake stroke of the pump piston; in the instance where gasoline is used as fuel, the feared buildup of vapor bubbles is precluded.

In another further embodiment of the invention, all the drive cams are provided with a cam detent keeping the associated pump pistons in their dead center position beyond a predetermined cam rotation angle. The cam detent rotation angle associated with this cam detent is at least equal to the cam rotation angle which corresponds to the supply range of the respective other pump piston or pistons triggered by the same overflow valve, to thus prevent an overlapping of the control times of the at least two pump pistons controlled by one overflow valve; at the same time, the maximum possible number of pump pistons triggerable by one overflow valve is limited.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
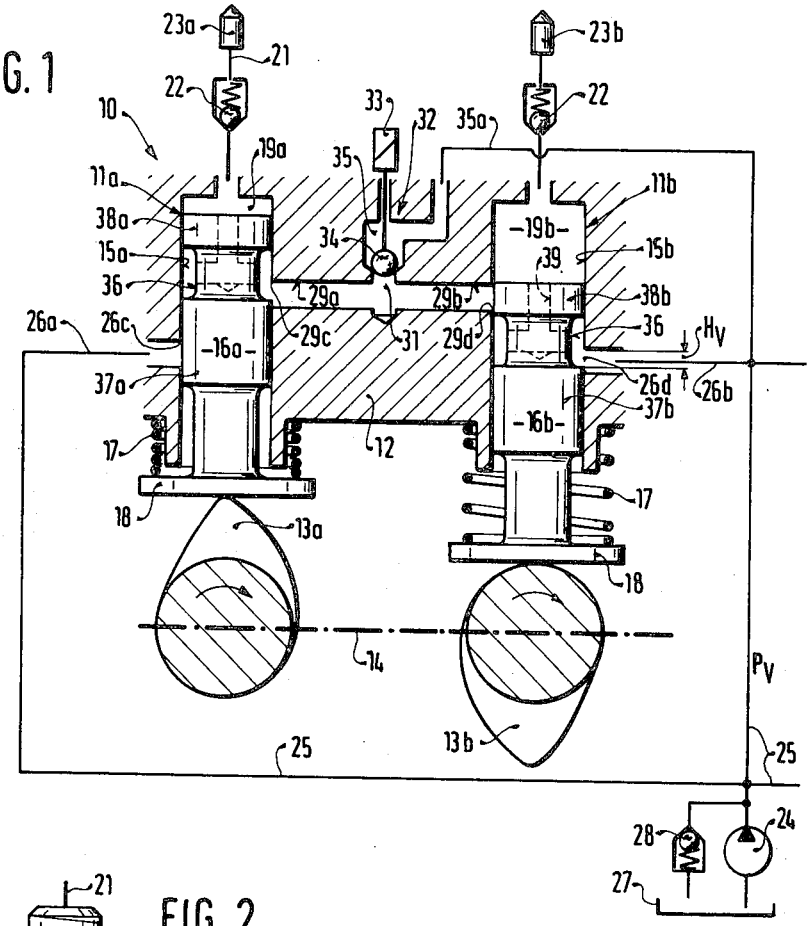
FIG. 1 is a simplified illustration of the first exemplary embodiment, having two pump elements shown in cross section and triggered by a common overflow valve.
Figure 2:
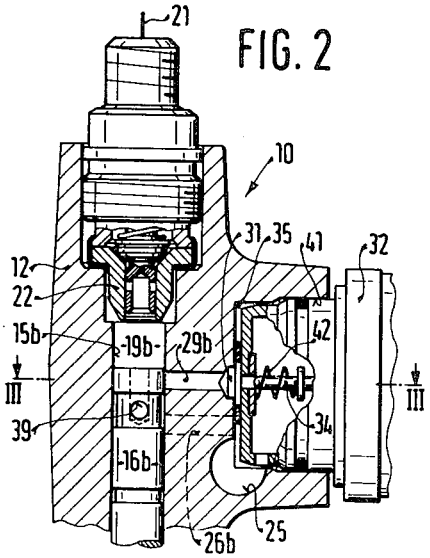
FIGS. 2 and 3 relate to a practical realization of a fuel injection pump for the first exemplary embodiment, each figure showing a section taken through the portion of the pump that is essential to the invention.
Figure 3:
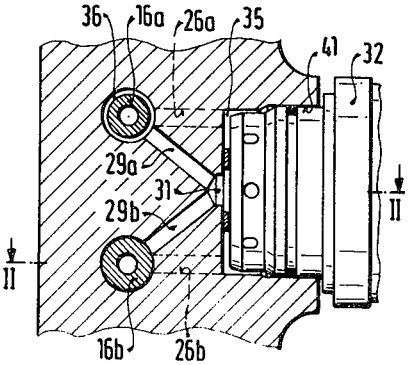

In the preferred first exemplary embodiment, shown in FIGS. 1–3, of the fuel injection apparatus according to the invention, there is a multi-cylinder fuel injection pump 10, of which for the sake of simplicity only two pump elements 11*a* and 11*b* are shown. The pump elements 11*a* and 11*b*, located in a pump housing 12 indicated merely by shading, each substantially comprise one drive cam 13*a* and 13*b* of a camshaft 14 common to all the pump elements, along with pump pistons 16*a*, 16*b* driven with a constant stroke and each guided in a cylinder bore 15*a* and 15*b*. Each of the pump pistons 16*a* and 16*b* is driven by the associated drive cam 13*a*, 13*b* counter to the force of a restoring spring 17 (a push rod, not shown, may selectively be interposed as well), via a piston base 18 acting as a spring plate. During the compression stroke, the fuel placed under injection pressure is positively displaced by the pump pistons out of respective pump chambers 19*a* and 19*b*, defined by the pump pistons 16*a* and 16*b*, and delivered to an injection nozzle 23*a* and 23*b*, respectively, via a pressure valve 22 inserted into a pressure line 21.

In the appropriate position of the pump pistons 16*a* and 16*b* to be described in detail later, the pump work chambers 19*a* and 19*b* are filled with fuel via filling conduits 26*a* and 26*b* connected to a filling line 25 which is common to all the pump elements 11*a* and 11*b* and is subjected to the supply pressure $p_V$ of a supply pump 24. The supply pump 24 aspirates the fuel from a tank 27, and the supply pressure $p_V$ prevailing in the filling line 25 is limited by a pressure limitation valve 28.

One overflow conduit 29*a* and 29*b*, respectively, is connected to each pump work chamber 19*a* and 19*b*, and the two conduits 29*a*, 29*b* are interconnected via a control chamber 31, embodied as a bore segment, of an electromagnetically actuated overflow valve 32. In the illustrated position, a valve element 34 actuatable by an electromagnet 33 blocks the outflow of fuel from the control chamber 31 to a low-pressure chamber 35, which in the present example is connected, as a chamber of lower pressure, to the filling line 25 via a line segment 35*a* and thus is subjected to the supply pressure $p_V$ of approximately 2 bar. As will be discussed in greater detail later in connection with FIGS. 2 and 3, this arrangement enables the conduit course to be greatly simplified and furthermore, when the overflow valve 32 is open, improves the filling of the pump work chambers 19*a* and 19*b*. It would also be possible to connect this low-pressure chamber 35 directly with the tank 27.

The pump pistons 16*a* and 16*b* each have two jacket face sections, separated from one another by an annular groove 36, of which those sections identified as 37*a* and 37*b* will be called "first control faces" and those identified by 38*a* and 38*b* will be called "second control faces". After a pre-stroke $H_V$, the first control face 37*a* or 37*b* closes the respective inlet opening 26*c* or 26*d* of the filling conduits 26*a* and 26*b*, and in the bottom dead center position (UT) of the pump pistons 16*a* and 16*b*, the second control face 38*a* or 38*b* keeps the respective overflow openings 29*c* and 29*d* closed but during the entire supply stroke itself keeps these openings open. In the first example shown in FIG. 1, the pump piston 16*a* is in the position which closes the inlet opening 26*c* and keeps the overflow opening 29*c* open, while the second pump piston 16*b* keeps the inlet openings 26*d* open while closing the overflow opening 29*d*.

Because of their function, the second control faces 38*a* and 38*b* are also called barrier valves, which advantageously do not require any additional space for installation and which are automatically controlled by the position of the pump pistons.

The annular grooves 36 of each pump piston 16*a* and 16*b* are permanently connected via one conduit 39 each, embodied by transverse and longitudinal bores, with the associated pump work chambers 19*a* and 19*b*.

FIGS. 2 and 3 each provide a sectional illustration of the characteristics essential to the invention in the first exemplary embodiment described above. FIG. 2 is a longitudinal section taken along the line II—II of FIG. 3, and FIG. 3 is a cross section taken along the line III—III of FIG. 2 through the corresponding portion of the practical embodiment of an injection pump 10. As may be seen from these illustrations, the pump pistons 16*a* and 16*b* are guided directly within the pump housing 12, which is preferably made of cast iron; the overflow conduits 29*a* and 29*b* discharge into the control chamber 31 which is closable by the valve member 34 of the overflow valve 32; and the filling conduits 26*a* and 26*b* discharge into the low-pressure chamber 35, which is embodied by an end portion, oriented toward the pump work chamber, of a reception bore 41 receiving the overflow valve 32 and at the same time is part of the filling line 25, which as shown in FIG. 2 is embodied inside the pump housing 12 by a longitudinal bore connecting the plurality of low-pressure chambers 35 as needed with the associated filling conduits 26*a*, 26*b*.

The valve member 34 of the overflow valve 32, which in FIG. 2 is provided with a hemispherical valve closing element, is urged in the opening direction by a valve spring 42 and is thus able to keep the connection from the control chamber 31 to the low-pressure chamber 35 open after the supply stroke has been completed, so that during the intake stroke of the pump pistons 16*a* and 16*b* the overflow lines 29*a* and 29*b* can simultaneously serve as supplementary filling lines and thus further reinforce the filling process. The pressure valve 22 shown in FIG. 2 is embodied as a port relief valve, known per se; however, it may be replaced at any time by some other type of valve, should this produce more favorable results because of hydraulic ratio.

Figure 4:
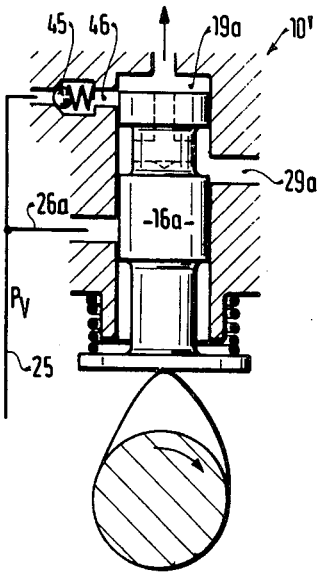
FIG. 4 is a detail of the second exemplary embodiment, which otherwise corresponds to the first exemplary embodiment, with a supplementary filling valve.

The fuel injection pump 10', of which only a detail is shown in FIG. 4, differs from the first exemplary embodiment solely in that the pump work chamber 19*a* can be filled with fuel, under the supply pressure $p_V$ of the supply pump 24, from the filling line 25 simultaneously supplying the first filling conduit 26*a* via a second filling conduit 46, which is provided with a check valve 45 opening toward the pump work chamber 19*a* and not subject to being influenced by the pump piston 16*a*. This feature is advantageous particularly in very high-speed engines in which the previously described procedure for filling the pump work chamber cannot be completely carried out within the length of time available for so doing.

Figure 5:
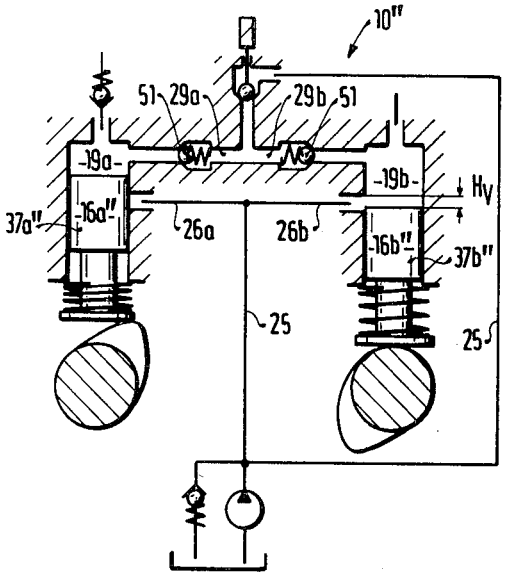
FIG. 5 shows the third exemplary embodiment.

In the third exemplary embodiment of a fuel injection pump 10'' shown in simplified form in FIG. 5, the pump pistons 16*a''* and 16*b''* are provided with a continuous cylindrical jacket face 37*a''* and 37*b''*, which assume only one single control function; acting as control faces, they open the inlet openings (not described in further detail here) of the filling conduits 26*a* and 26*b* after the prestroke $H_V$ has been completed. The functioning of the barrier valve which blocks off the pump work chamber not being actuated at a given time, e.g. 19*a*, from the pump work chamber placed under injection pressure at that time, e.g. 19*b*, is assumed by a check valve 51, one of which is inserted into each overflow conduit 29*a* and 29*b* and closes in the direction of the respective pump work chambers 19*a* and 19*b*. As a result, a separate control face is not required on the pump piston, the sealing length of the pump piston becomes greater and the strain which can be placed on the pump piston is thereby increased.

Figure 6:
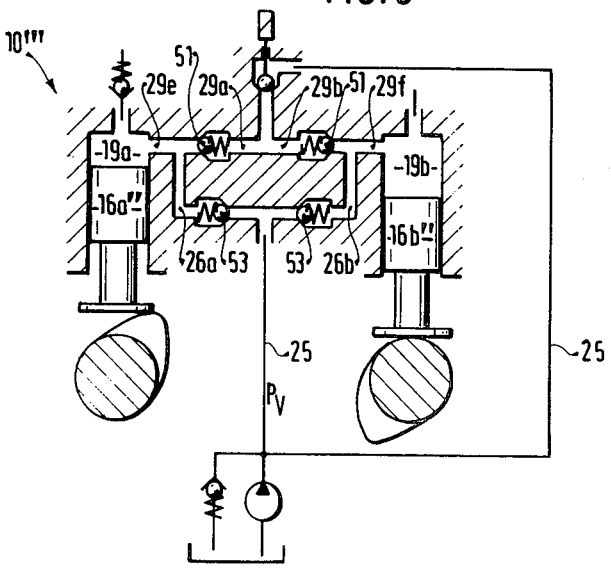
FIG. 6 shows the fourth exemplary embodiment.

The fourth exemplary embodiment shown in FIG. 6 differs only a little from the previously described third exemplary embodiment shown in FIG. 5. Identical elements are thus identified by identical reference numerals. The pump pistons 16*a''* and 16*b''*, provided as in FIG. 5 with an uninterrupted cylindrical jacket face, no longer have a control function of any kind in this exemplary embodiment. To this end, a filling valve 53 opening toward the pump work chamber 19*a* and 19*b* and preferably embodied as a check valve is inserted into each filling conduit 26*a* and 26*b* connected to the filling line 25. In that event, however, the respective discharge points of the filling conduits 26*a* and 26*b* must be so placed that the pump pistons 16*a''* and 16*b''* is not capable of closing them. To this end, each filling conduit 26*a* and 26*b* in FIG. 6 is located such that it discharges into a segment 29*e* or 29*f* of the overflow conduit 29*a* or 29*b* located between the barrier valve 51 and the pump work chamber 19*a* or 19*b*. The sealing effect of the pump piston here is still further improved, that is, its total installed length can be shortened. At an appropriate supply pressure $p_V$, as shown, the restoring springs 17 used in the other exemplary embodiments can be eliminated.

Figure 7:
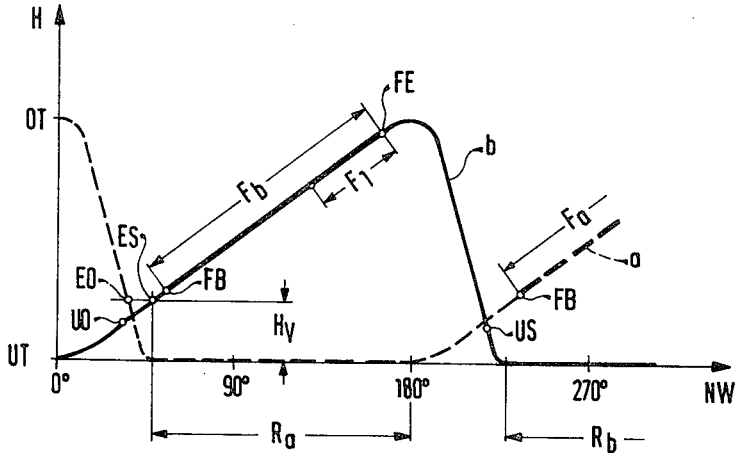
FIG. 7 is a control diagram.

In the control diagram shown in FIG. 7, the camshaft rotation angle NW is plotted in degrees (°) on the abscissa and the associated cam stroke H is plotted in the ordinate, between the bottom and top dead center positions marked at UT and OT, respectively. The cam stroke curves a and b given in the diagram are plotted for the use of the fuel injection apparatus according to the invention in connection with an internal combustion engine having externally supplied ignition and a stratified charge; this usage, in contrast to injection systems for Diesel engines, requires a very wide supply range, for instance 110° of cam angle, because very large shifts in injection onset must be made, dependent on both rpm and on load, each shift amounting for instance to 30° of cam angle. Given an arrangement of this kind, only two pump elements can be triggered by one electrically actuated overflow valve 32 at a time. For this reason, the two cam stroke curves—that is, cam stroke curve a plotted as a broken line, and cam stroke curve b plotted as a solid line—are offset by 180° from one another. The respective slowest possible supply ranges $F_a$ and $F_b$ required for low rpm are entered in the form of heavier line segments within the cam stroke curves a and b; these ranges $F_a$ and $F_B$ begin at the earliest possible supply onset FB and end at the latest possible end of supply FE. The supply duration $F_1$ for a supply period beginning as late as possible and ending at FE for the largest possible supply quantity is additionally entered within the supply range segment $F_b$. At UO, the overflow opening 29*c* is opened, and at US it is closed once again. $H_V$ marks the pre-stroke, and the associated opening and closing instants of the inlet opening 26*a* or 26*b* are marked by EO and ES, respectively. The significance of the individual segments and control points will be described in further detail below in connection with the functioning of the apparatus.

Figure 8:
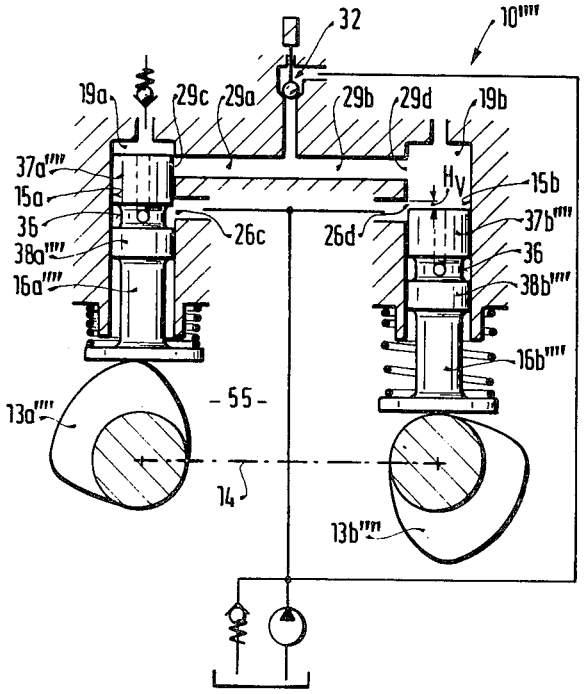
FIG. 8 shows the fifth exemplary embodiment.

The fifth exemplary embodiment, shown in FIG. 8, differs from the first exemplary embodiment essentially only in that the drive cams 13*a*'''' and 13*b*'''' of the injection pump 10'''' are equipped with a cam detent for the top dead center position OT of the pump pistons 16*a*'''' and 16*b*''''. The control faces marked as 37*a*'''' and 37*b*'''' here have a dual control function. After the pre-stroke $H_V$, they control the closure of the inlet openings 26*c* and 26*d* and at the top dead center position OT of the pump pistons 16*a*'''', 16*b*'''' they close the overflow openings 29*c*, 29*d* and thus simultaneously act as barrier valves. The pump piston 16*a*'''' is shown in FIG. 8 in the blocking position described above, in which it disconnects the pump work chamber 19*a* from the pump work chamber 19*b* which is placeable under injection pressure after the pre-stroke $H_V$ has been completed and when the overflow valve 32 is closed. The annular groove 36 is designed such that it opens the inlet openings 26*c*, 26*d* during the upward stroke of the pump piston 16*a*'''', 16*b*'''', shortly before OT and before the control face 37*a*'''' or 37*b*'''' closes the associated overflow opening 29*c* or 29*d*, so that after the pump work chamber 19*a*, 19*b* has been closed no further supply of fuel takes place. The control face 37*a*'''', 37*b*'''' of each pump piston is embodied by a first cylindrical jacket face portion and is separated by the annular groove 36 from a second jacket face portion 38*a*'''', 38*b*'''', which has no control function but instead seals off the annular groove 36 with respect to a camshaft chamber 55.

Because there is a shorter amount of time available for filling in this exemplary embodiment as compared with the exemplary embodiment described earlier, it is advantageous here as well to use the supplementary check valve 45, described in connection with FIG. 4, in order to improve filling. (This usage is not shown in the drawings.)

The mode of operation of the first exemplary embodiment shown in FIGS. 1–3 will now be described in greater detail, referring to the control diagram of FIG. 7.

The curve b is associated with the second pump piston 16*b* located in its bottom dead center position UT, and the curve a is associated with the first pump piston 16*a* in its top dead center position OT. If the drive cams 13*a* and 13*b* now rotated clockwise as shown by the arrows, then at 0° cam angle, the pump piston 16*a* begins its intake stroke and the pump piston 16*b* begins its supply stroke, which after the pre-stroke $H_V$ has been completed closes the inlet opening 26*d* by means of the first control face 37*b* at the control point ES. Since the overflow opening 29*d* has already been opened, at UO, by the second control face 38*b*, the pump supply begins once the control valve 32 blocks the outflow of fuel from the overflow conduits 29*a* and 29*b* to the filling line 25. The earliest possible supply onset is plotted as FB, shortly after ES, although it may also coincide with ES. The pump supply is terminated once the overflow valve 32 has again connected the control chamber 31 with the low-pressure chamber 35 and, via the line segment 35*a*, with the filling line 25, so that the corresponding pressure reduction causes the associated pressure valve 22 to close, thus also closing the injection nozzle 23*b*. This instant of closure is located between FB and FE and is dependent upon the rpm, the required fuel quantity and the actual supply onset directed at a particular time. As may be inferred from the solid-line curve b, the intake stroke of the second pump piston 16*b* begins after 180° cam angle, while the first pump piston 16*a* begins its supply stroke at that time, as may be inferred from the broken-line curve a. Over the entire possible supply range $F_b$ for the second pump piston 16*b*, the first pump piston 16*a* is located in a cam detent marked $R_a$ in its bottom dead center position UT; during this period of time, this pump piston 16*a*, with its second control face 38*a*, keeps the overflow opening 29*c* closed, and it begins its supply stroke in turn after 180° cam angle, at which only the first portion of its supply stroke $F_a$, beginning at FB, is plotted for the period which the second pump piston 16*b* spends in its associated cam detent $R_b$.

If a shorter supply range should be required, for instance for a different combustion process, then it is also possible for more than two pump pistons to be controlled by a single overflow valve 32.

The mode of operation described above also pertains to the second exemplary embodiment of FIG. 4, and it can also be applied to the third exemplary embodiment of FIG. 5. Since in this third exemplary embodiment the continuous control faces 37*a*'' and 37*b*'' control only the inlet openings of the filling conduits 26*a* and 26*b*, while the overflow conduits 29*a* and 29*b* are controlled by barrier valves 51, the control points UO and US are eliminated in this exemplary embodiment.

In the fourth exemplary embodiment shown in FIG. 6, the pump pistons 16*a*'' and 16*b*'' have no control function, since the filling valves 53 are located in the filling conduits 26*a* and 26*b* and the check valves 51 are located in the overflow conduits 29*a* and 29*b*, being automatically opened or closed in response to the pressures prevailing in the pump work chambers 19*a* and 19*b*. The respective supply range $F_a$ and $F_b$ also occurs during the period of the associated cam detent $R_b$ and $R_a$ in this exemplary embodiment.

In the fifth exemplary embodiment of FIG. 8, the cam detent $R_a$, $R_b$ of the drive cams 13*a*'''', 13*b*'''' is controlled at top dead center OT, so that the control diagram of FIG. 7 actually applies only to the description of the mode of operation of this fifth embodiment. The control faces 37*a*'''' and 37*b*'''', after the pre-stroke $H_V$, close the inlet openings 26*a*, 26*b*, and at OT they simultaneously serve as barrier valves closing the overflow openings 29*c*, 29*d*. The other functions correspond to those described for the embodiment shown in FIGS. 1–3.

The fuel injection pumps shown in the exemplary embodiments are shown as part of an in-line injection pump, as may be inferred from FIG. 3; naturally, other known types of pump may also be selected, such as V-pumps, dual-line injection pumps or so-called drum pumps, whose pump pistons, grouped around a central valve, are driven by an end-face cam disc.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An electrically controlled fuel injection apparatus for multi-cylinder internal combustion engines, in which each pump piston of a fuel injection pump, driven at a constant stroke by a drive cam of a camshaft and guided in a cylinder bore, supplies the fuel placed under injection pressure in an associated pump work chamber via a pressure valve to an injection nozzle until such time as a valve element of an electrically actuated overflow valve blocks the flow of the fuel overflowing from the pump work chamber via an overflow conduit to a chamber of lower pressure, said apparatus having an inlet opening of a filling conduit which is under the supply pressure $p_V$ of a supply pump, the inlet opening being closable by a first control face on the jacket face of the pump piston after a pre-stroke $H_V$ of the pump piston has been completed, and having an overflow opening in the wall of each cylinder bore serving as the discharge point of the oveflow conduit, the overflow conduits of at least two adjacent pump work chambers are interconnected and the return flow of fuel out of these overflow conduits to the chamber of lower pressure is controllable by the valve element of the overflow valve common to these overflow conduits, that the overflow conduits are each provided with a barrier valve, by means of which the at least one pump work chamber which is not under injection pressure can be blocked off from the pump work chamber which is under injection pressure at that time, and a second control face on the pump piston closing the overflow opening in one of the dead center positions of the pump piston acts as the barrier valve.

2. A fuel injection apparatus as defined by claim 1, wherein the fuel injection apparatus is an apparatus for direct fuel injection in internal combustion engines, having externally supplied ignition.

3. A fuel injection apparatus as defined by claim 1, wherein said one of the dead center positions of the pump piston is the bottom dead center position.

4. A fuel injection apparatus as defined by claim 1, characterized in that both control faces are embodied by jacket face sections of the pump piston separated from one another by an annular groove, and that the annular groove is permanently connected with the pump work chamber via a conduit disposed in the pump piston, and said second control face of the pump piston acts as a barrier valve.

5. A fuel injection apparatus as defined by claim 1, in which said control face on the pump piston acts as the barrier valve closing the overflow opening in one of the dead center positions of the pump piston. characterized in that the control face on the pump piston acts as the barrier valve closing the overflow opening in one of the dead center positions of the pump piston.

6. A fuel injection apparatus as defined by claim 5, wherein said one of the dead center positions of the pump piston is the top dead center position.

7. A fuel injection apparatus as defined by claim 5, characterized in that the control face is embodied by a first jacket face section of the pump piston and is separated by an annular groove from a second jacket face section, and that the annular groove is permanently connected with the pump work chamber via a conduit disposed in the pump piston.

8. A fuel injection apparatus as defined by one of the claims 1, characterized in that the pump work chamber can be filled with fuel under supply pressure $p_V$ from a filling line via a second filling conduit which is provided with a check valve opening toward the pump work chamber and is not capable of being influenced by the pump piston.

9. A fuel injection apparatus as defined by claim 1, characterized in that the filling conduits of the respective pump work chambers controlled by said overflow valve are connected to a low-pressure chamber of the overflow valve which chamber separable from the overflow conduits by the valve element of said overflow valve, and that the low-pressure chamber is embodied by an end portion, oriented toward the pump, of a reception bore receiving the overflow valve and also serves as the chamber of lower pressure.

10. A fuel injection apparatus as defined by claim 4, characterized in that the filling conduits of the respective pump work chambers controlled by said overflow valve are connected to a low-pressure chamber of the overflow valve which is separable from the overflow conduits by the valve element, and that the low-pressure chamber is embodied by an end portion, oriented toward the pump, of a reception bore receiving the overflow valve and also serves as the chamber of lower pressure.

11. A fuel injection apparatus as defined by claim 5, characterized in that the filling conduits of the respective pump work chambers controlled by said overflow valve are connected to a low-pressure chamber of the overflow valve which chamber is separable from the overflow conduits by the valve element of said overflow valve, and that the low-pressure chamber is embodied by an end portion, oriented toward the pump, of a reception bore receiving the overflow valve and also serves as the chamber of lower pressure.

12. A fuel injection apparatus as defined by claim 7, characterized in that the filling conduits of the respective pump work chambers controlled by an overflow valve are connected to a low-pressure chamber of the overflow valve which is separable from the overflow conduits by the valve element, and that the low-pressure chamber is embodied by an end portion, oriented toward the pump, of a reception bore receiving the overflow valve and also serves as the chamber of lower pressure.

13. A fuel injection pump as defined by claim 9, characterized in that the pump work chamber can be filled with fuel under supply pressure from a filling line via a second filling conduit which is provided with a check valve opening toward the pump work chamber and is not capable of being influenced by the pump piston.

14. A fuel injection apparatus as defined by one of the claims 9–12, characterized in that the fuel injection pump is embodied as a multi-cylinder fuel injection pump, and that the low-pressure chambers of at least two overflow valves are connected with one another and with the supply pump placing the fuel under supply pressure $p_V$ via a filling line.

15. A fuel injection apparatus as defined by claim 1, in which all the drive cams are provided with a cam detent keeping the associated pump pistons in their dead center positions beyond a predetermined cam rotation angle, characterized in that the cam detent rotation angle associated with this cam detent is at least equal to the cam rotation angle which corresponds to the supply range of the respective other pump piston or pistons triggered by the same overflow valve.

16. A fuel injection apparatus as defined by claim 4 characterized in that the pump work chamber can be filled with fuel under supply pressure $p_V$ from a filling line via a second filling conduit which is provided with a check valve opening toward the pump work chamber and is not capable of being influenced by the pump piston.

17. A fuel injection apparatus as defined by claim 5 characterized in that the pump work chamber can be filled with fuel under supply pressure $p_V$ from a filling line via a second filling conduit which is provided with a check valve opening toward the pump work chamber and is not capable of being influenced by the pump piston.

18. A fuel injection apparatus as defined by claim 7 characterized in that the pump work chamber can be filled with fuel under supply pressure $p_V$ from a filling line via a second filling conduit which is provided with a check valve opening toward the pump work chamber and is not capable of being influenced by the pump piston.

19. A fuel injection pump as defined by claim 10, characterized in that the pump work chamber can be filled with fuel under supply pressure from a filling line via a second filling conduit which is provided with a check valve opening toward the pump work chamber and is not capable of being influenced by the pump piston.

20. A fuel injection pump as defined by claim 11, characterized in that the pump work chamber can be filled with fuel under supply pressure from a filling line via a second filling conduit which is provided with a check valve opening toward the pump work chamber and is not capable of being influenced by the pump piston.

21. A fuel injection pump as defined by claim 12, characterized in that the pump work chamber can be filled with fuel under supply pressure from a filling line via a second filling conduit which is provided with a check valve opening toward the pump work chamber and is not capable of being influenced by the pump piston.

22. A fuel injection apparatus as defined by claim 9 characterized in that the fuel injection pump is embodied as a multi-cylinder fuel injection pump, and that the low-pressure chambers of at least two overflow valves are connected with one another and with the supply pump placing the fuel under supply pressure $p_V$ via a filling line.

23. A fuel injection apparatus as defined by claim 10 characterized in that the fuel injection pump is embodied as a multi-cylinder fuel injection pump, and that the low-pressure chambers of at least two overflow valves are connected with one another and with the supply pump placing the fuel under supply pressure $p_V$ via a filling line.

24. A fuel injection apparatus as defined by claim 11 characterized in that the fuel injection pump is embodied as a multi-cylinder fuel injection pump, and that the low-pressure chambers of at least two overflow valves are connected with one another and with the supply pump placing the fuel under supply pressure $p_V$ via a filling line.

25. A fuel injection apparatus as defined by claim 12 characterized in that the fuel injection pump is embodied as a multi-cylinder fuel injection pump, and that the low-pressure chambers of at least two overflow valves are connected with one another and with the supply pump placing the fuel under supply pressure $p_V$ via a filling line.

26. A fuel injection apparatus as defined by claim 5, in which all the drive cams are provided with a cam detent keeping the associated pump pistons in their dead center positions beyond a predetermined cam rotation angle, characterized in that the cam detent rotation angle associated with this cam detent is at least equal to the cam rotation angle which corresponds to the supply range of the respective other pump piston or pistons triggered by the same overflow valve.

* * * * *